United States Patent [19]

White et al.

[11] Patent Number: 4,962,773

[45] Date of Patent: Oct. 16, 1990

[54] PROCESS FOR THE MANUFACTURE TOBACCO RODS CONTAINING EXPANDED TOBACCO MATERIAL

[75] Inventors: Jackie L. White, Pfafftown; Robert E. Grubbs, Lexington; Hoyt S. Beard, Winston-Salem; Mark L. Raker, Clemmons; Thomas A. Perfetti, Winston-Salem; Richard G. Haberkern, King, all of N.C.

[73] Assignee: R. J. Reynolds Tobacco Company, Winston-Salem, N.C.

[21] Appl. No.: 85,439

[22] Filed: Aug. 13, 1987

[51] Int. Cl.[5] ..... A24B 3/18; A24C 5/60

[52] U.S. Cl. ..... 131/291; 131/296; 131/901

[58] Field of Search ..... 131/292, 291, 296, 901, 131/295, 294, 293

[56] References Cited

U.S. PATENT DOCUMENTS

| | | | |
|---|---|---|---|
| 3,223,090 | 12/1965 | Strubel et al. | 131/292 |
| 3,524,451 | 8/1970 | Fredrickson . | |
| 3,773,055 | 11/1973 | Stungis et al. | 131/294 |
| 3,828,797 | 8/1974 | Neumann et al. . | |
| 4,153,063 | 5/1979 | Roselius et al. . | |
| 4,235,250 | 11/1980 | Utsch . | |
| 4,243,056 | 1/1981 | de la Burde et al. . | |
| 4,289,148 | 9/1981 | Ziehn . | |
| 4,461,310 | 7/1984 | Ziehn . | |
| 4,531,529 | 7/1985 | White et al. . | |
| 4,561,452 | 12/1985 | Gahrs . | |
| 4,577,646 | 3/1986 | Ziehn . | |
| 4,727,889 | 3/1988 | Niven, Jr. et al. . | |

FOREIGN PATENT DOCUMENTS 675292 7/1952 United Kingdom .

OTHER PUBLICATIONS

*Agnew. Chem. Int. Eg. Engl.*, pp. 710–715 (1978), Hubert et al.

*Primary Examiner*—V. Millin

[57] ABSTRACT

Cigarette rods and filter rods are provided by manufacturing rods from tobacco cut filler and a circumscribing paper wrap, and then subjecting the rods to conditions such that the cut filler undergoes volume expansion while within the paper wrap. For example, the tobacco rods can be exposed to propane under supercritical conditions within a pressure chamber followed by a venting of the gaseous fluid to expand the tobacco cut filler. The resulting rods are very firm, have good integrity, and frequently do not undergo any noticeable visible change. The resulting rods which contain the volume expanded tobacco can be used as smokable rods for cigarettes or as cigarette filters.

29 Claims, 2 Drawing Sheets

PROCESS FOR THE MANUFACTURE TOBACCO RODS CONTAINING EXPANDED TOBACCO MATERIAL

BACKGROUND OF THE INVENTION

This invention relates smoking articles, and in particular to rod-shaped smoking articles containing volume expanded tobacco material.

Popular smoking articles such as cigarettes comprise a substantially rod shaped structure and include a charge of smokable material such as shredded tobacco (i.e., cut filler) surrounded by a circumscribing wrapper such as paper thereby forming a tobacco rod. In certain instances, a portion of the tobacco material can be material which has been subjected to volume expansion techniques as described by Fredrickson in U.S. Pat. No. 3,524,451; and White et al in U.S. Pat. No. 4,531,529. It has been desirable to manufacture cigarettes each having a cylindrical filter element aligned in an end-to-end relationship with the tobacco rod. Typically, filter elements are manufactured from fibrous materials such as cellulose acetate and are circumscribed by paper plug wrap. The filter element is attached to the tobacco rod using a circumscribing tipping material.

It would be desirable to provide a smoking article such as a cigarette which has a unique filter element. In addition, it would be desirable to provide an efficient and effective method for providing expanded tobacco material within a tobacco rod. Also, it would be desirable to provide a smokable rod having a very light weight but firmness comparable to a conventional tobacco rod.

SUMMARY OF THE INVENTION

The present invention relates to the preparation of rods suitable as smokable tobacco rods or for the preparation of filter elements. Preferred tobacco rods exhibit a relatively low weight as compared to conventional cigarettes of similar configuration. Such rods are provided by subjecting a tobacco rod having a plurality of pieces (eg., strands or shreds) of tobacco material (hereinafter referred to as "filler") contained in a generally tubular shaped circumscribing wrapping material to conditions sufficient to provide volume expansion to at least a portion of the tobacco material.

In the preferred aspect, the volume expansion of the tobacco material is provided by subjecting the rod to conditions sufficient to increase the volume of the tobacco material. Preferably, the rod is subjected to contact with a gaseous fluid under supercritical conditions in order to provide impregnation of the fluid within the tobacco. The impregnation step is followed by release of the fluid to provide volume expansion to at least a portion of the individual strands or shreds. Of particular interest is the fact that volume expansion using a supercritical fluid can be performed at relatively low temperatures in order that the wrapping material (which typically is a combustible cellulosic material) is not damaged to any appreciable degree.

The process of this invention allows for the efficient and effective preparation of firm tobacco rods. Of particular interest is that rods having an outer wrapping material and tobacco material contained therein can be manufactured, and then the tobacco material can be subjected to volume expansion conditions while the tobacco material is contained within the wrapping material. The rods so processed can be very firm in character, and the firmness of each rod can be very uniform along the length thereof. The firm rods so provided exhibit good integrity whereby the tobacco material does not readily undergo "fall out" from the ends thereof.

DETAILED DESCRIPTION OF THE EMBODIMENTS

Figure 1:
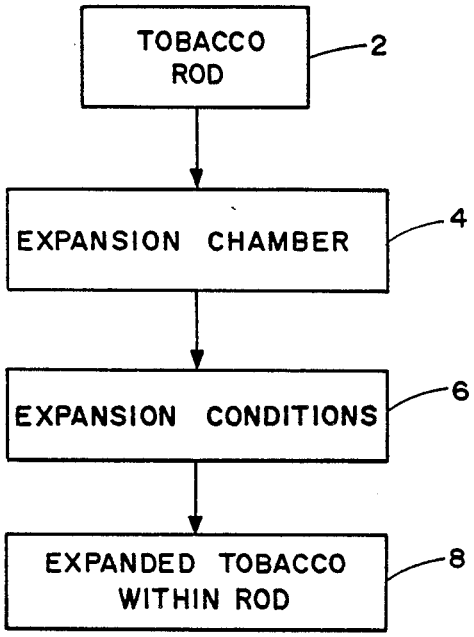
FIG. 1 is a schematic diagram of a set of processing steps of this invention.

Referring to FIG. 1, rod 2 (also referred to as a "tobacco rod") is manufactured using conventional cigarette rod-making techniques and is placed into expansion chamber 4. The rod 2 within the expansion chamber is subjected to expansion conditions 6 to provide volume expansion to at least a portion of the tobacco material within the rod. The resulting rod 8, which includes the volume expanded tobacco material, is removed from the expansion chamber 4 and employed in smoking article manufacture.

Alternatively, rod 2 can be incorporated into a cigarette (i.e., used for cigarette manufacture). Rod 2 then is subjected to the expansion conditions in expansion chamber 4 thereby providing rod 8 containing expanded tobacco within the cigarette. The resulting cigarette can be used in a conventional manner.

Figure 2:
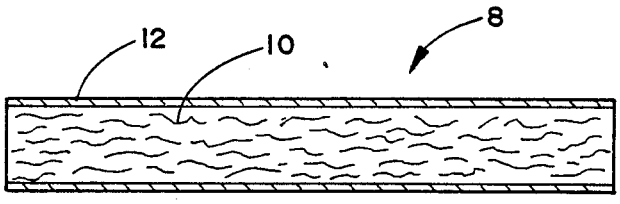
FIGS. 2–5 are longitudinal sectional views of various smoking articles of this invention.

Referring to FIG. 2, rod 8 has a generally cylindrical shape and includes particulates of volume expanded tobacco material 10 contained in wrapping material 12. Typically, the wrapping material is conventional cigarette paper wrap, or the like. The tobacco material is volume expanded while within the wrapping material using the previously described processing steps. The tobacco rod can be employed as a "cigarette rod" providing the burnable portion of a cigarette (as shown in FIGS. 3 and 4) or subdivided into two or more cylindrical shaped filter elements for the manufacture of cigarettes having tobacco-containing filter elements (as shown in FIG. 5).

Figure 3:
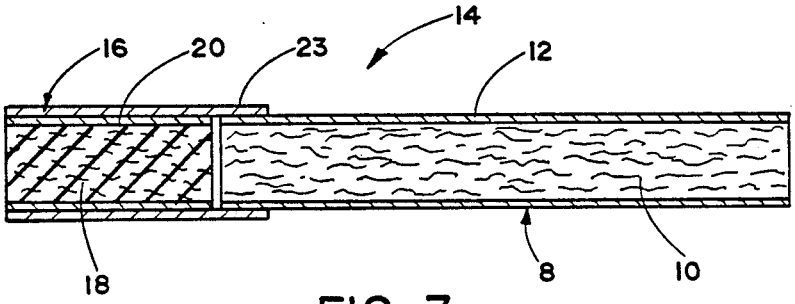

Referring to FIG. 3, smoking article 14 has the form of a cigarette. The article 14 includes rod 8 including volume expanded tobacco material 10 contained in wrapping material 12. The rod also can include other smokable materials. The ends of rod 8 are open to expose the smokable material. Rod 8 has a circumference comparable to that of conventional cigarettes and generally ranges from about 17 mm to about 28 mm. Typically, the length of the rod ranges from about 55 mm to about 85 mm. The smoking article further includes filter element 16 positioned adjacent one end of rod 8 such that the filter element is aligned with the rod in an end-to-end relationship. Filter element 16 has a cross sectional shape similar to that of rod 8. Typically, the filter element includes a cylinder 18 of filter material (eg., cellulose acetate, or the like) which is overwrapped along the longitudinally extending surface thereof with wrapping material 20 such as paper plug wrap, or the like. The filter element has a longitudinally extending length which can vary. Generally, the length of the filter element ranges from about 20 mm to about 35 mm. The filter element 16 is attached to the rod 8 by tipping material 23 which circumscribes both the filter element and an adjacent region of the rod. The inner surface of the tipping material 23 is fixedly secured (eg., using an adhesive) to the outer surface of the filter element 16 and to the wrapping material 12 of an adjacent region of the rod 8. The tipping material 23 circumscribes the rod 8 over a longitudinal length which can vary but is typically that length sufficient to provide good attachment of the filter element to the rod. The tipping material can be either a conventional air permeable tipping material or a conventional substantially air impermeable tipping material. Typically, the tipping material is tipping paper. If desired, openings such as slits, holes, or perforations in the substantially air impermeable tipping material and the plug wrap can provide a means for air dilution of the smoking article.

Figure 4:
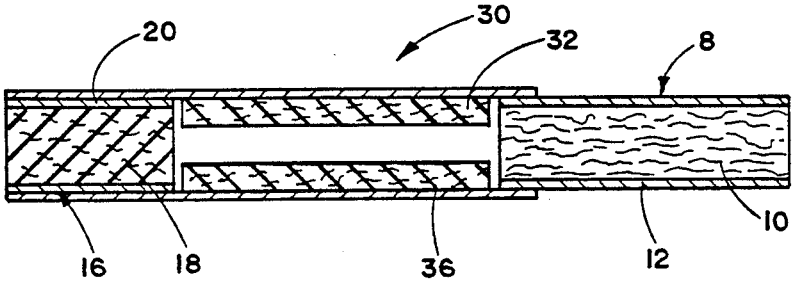
Figure 5:
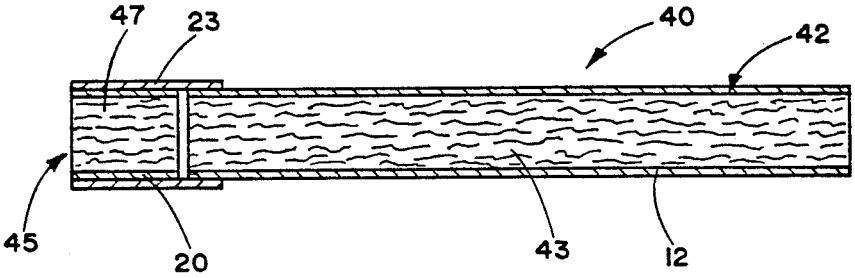

Referring to FIG. 4, a cigarette-type smoking article 30 includes a generally cylindrical rod 8 of smokable material 10 contained in wrapping material 12. The cylindrical rod 8 is also referred to as a "tobacco rod." A tubular member 32 or other suitable rod-shaped member which can provide a passageway for the flow of smoke and air therethrough is positioned adjacent one end of the tobacco rod 8. A cylindrical filter element 16 is positioned adjacent one end of the tubular member 32. The tobacco rod, tubular member and filter element are secured in essentially abutting end-to-end alignment by circumscribing outer wrapping material 36. The outer wrapping material (eg., tipping paper or other cigarette paper wrap) is adhesively secured to the outer peripheral surfaces of the filter element, the tubular member, and a portion of the length of the tobacco rod adjacent the tubular member. The outer wrap thus acts as a tipping material. Other configurations of wrapping materials and tipping materials for securing the tobacco rod, the tubular member and the filter element in alignment will be apparent to the skilled artisan.

The smokable material includes filler (eg., shreds or strands) of volume expanded tobacco materials or blends of the volume expanded tobacco materials with other smokable materials such as tobacco substitutes, carbonized or pyrolyzed materials, or the like. The rod is manufactured according to the aforementioned process whereby the filler is subjected to volume expansion conditions while contained within the circumscribing wrap 12. The tobacco rod typically has a circumference of about 17 mm to about 28 mm, and a length of from about 20 mm to about 50 mm, preferably from about 25 mm to about 35 mm.

The tubular member 32 can be a hollow tube or any other means which provides some type of essentially unrestricted passageway for smoke from the tobacco rod to the filter element. For example, the tubular member can be provided from a resilient, plasticized hollow cellulose acetate tube which is sold commercially as SCS-1by American Filtrona Corp.; from a paperboard tube; from an extruded tobacco tube, from a high temperature plastic tube, or the like. Typically, the circumference of the tubular member approximates that of the tobacco rod. The length of the tubular member typically ranges from about 15 mm to about 50 mm, preferably from about 30 mm to about 40 mm.

The filter element 16 can be any filter element useful for cigarette manufacture. For example, the filter element includes filter material 18 which is contained in a circumscribing paper plug wrap 20. Suitable filter materials include cellulose acetate tow, polypropylene tow, paper, or the like. Typically, the circumference of the filter element approximates that of the tobacco rod. The length of the filter element typically ranges from about 10 mm to about 45 mm, preferably about 15 mm to about 25 mm.

An example of a preferred smoking article 30 is a cigarette-type article having a length of about 84 mm and a circumference of about 24 mm. The article includes a tobacco rod (which is provided according to the process of this invention) having a length of 30 mm, a tube having a length of about 35 mm, and a filter element having a length of about 20 mm, aligned in an abutting end-to-end relationship.

The pressure drop of the article 30 is generally comparable to that of a conventional cigarette. For example, typical pressure drop values for the smoking article can range from about 70 mm to about 170 mm, preferably from about 80 mm to about 130 mm of water pressure drop at 17.5 ml/sec. of air flow rate.

Referring to FIG. 5, cigarette-type smoking article 40 has a rod 42 including smokable material 43 (eg., cut filler) contained in wrapping material 12. The rod 42 has a configuration, length and circumference comparable to that of a conventional cigarette. The smoking article further includes filter element 45 positioned adjacent one end of rod 42 such that the filter element is aligned with the rod in an end-to-end relationship. Filter element 45 has a cross sectional shape similar to that of rod 42. The filter element includes volume expanded tobacco material 47 which is overwrapped along the longitudinally extending surface thereof with wrapping material 20 such as cigarette paper wrap, paper plug wrap, or the like. The length of the filter element can vary, but is generally comparable to that of conventional cigarette filter elements. The filter element 45 is attached to rod 42 by tipping material 23. Filter element 45 can be employed as the filter element for the embodiments shown in FIGS. 3 and 4.

Filter element 45 is provided from a rod which has been subjected to the previously described process for volume expanding the filler while the tobacco material is in a component of a rod. For example, the rods can be the so-called "four up" or "six up" rods, or the like. In particular, the rods can be cut to the desired size, (eg., during cigarette manufacturing stages) resulting in cylindrical filter elements for the manufacture of filter cigarettes. Typical rod sizes for use in the manufacture of filter elements range in length from about 40 mm or less to about 150 mm, and from about 16 mm to about 27 mm in circumference. For example, a typical rod having a 100 mm length and 24.53 mm circumference exhibits a pressure drop of from about 200 mm to about 1200 mm, more typically from about 250 mm to about 600 mm, of water as determined at an airflow rate of 17.5 cc/sec using an encapsulated pressure drop tester, sold commercially as Model No. FTS-300 by Filtrona Corporation. If desired, the filter elements so provided can be plug tube combined with cellulose acetate filter elements and attached to cigarette rods.

Of particular interest is the fact that the tobacco-containing filter elements, when employed as filter elements for filter cigarettes, are capable of providing the user of such a cigarette with a unique tobacco taste. Also of interest is the fact that the structure of the tobacco-containing filter elements are such that the resulting filter elements exhibit good firmness and integrity. Thus, the discomfort associated with tobacco particles being drawn into the cigarette user's mouth is minimized or eliminated under conditions of normal use. As a consequence, the firm tobacco-containing filter elements provide suitable mouthend pieces for cigarettes.

Typical rods and filter elements of this invention exhibit good firmness and good integrity. The filter elements of this invention normally exhibit a firmness value of less than 3 units characteristic of a cylindrical rod shaped element having a circumscribing wrap (eg., cigarette paper), which rod has a length of about 100 mm and circumference of about 24.5 mm as measured at 76°F. and 60 percent relative humidity using a Cigarette Firmness Tester Model No. CFTA supplied by Fairchild Industries, Winston-Salem, N.C. As used herein, the term "units" in referring to the firmness value represents each 0.1 mm of vertically measured depression exhibited by the filter element when subjected to a force in the form of a load supplied transversely to the longitudinal axis thereof (i.e., the direction of the force supplied by the load is perpendicular to the longitudinal axis of the filter element). The depression exhibited by the filter element is determined by subjecting a 1 inch diameter, flattened stainless steel testing pad equipped with a load (total weigh thereof is about 20 g) which rests on the filter element to the force provided by a 205 g load which is placed on the testing pad for a period of 5 seconds. A low measured firmness value represents a high firmness for the sample. Preferred rods for certain applications and typical filter elements have firmness values of less than 2 units, more frequently less than 1 unit.

The tobacco materials useful in this invention can vary. Generally, tobacco materials which can undergo volume expansion include flue-cured, burley or oriental tobaccos, or blends thereof, in cut filler form. As used herein, the term "filler" is meant to refer to pieces, shreds or strands of a size capable of providing the filler portion of a tobacco rod. Typically, the tobacco materials are employed in the form of shreds or strands, such as cut filler. Suitable strands have widths which range from about 1/20 inch to about 1/90 inch, preferably from about 1/25 inch to about 1/50 inch; and lengths which range from about 0.12 inch to about 3 inches. If desired, the aforementioned tobacco materials can be blended with smokable material filler which undergo volume expansion to a limited degree. Such smokable materials can include reconstituted tobacco materials which are provided from papermaking type processes, tobacco cut filler which has been previously volume expanded, tobacco stems, or other such materials.

The wrapping material preferably is any wrapping material suitable for the manufacture of cigarettes, and which can withstand the processing conditions to which the rod is subjected during the expansion processing stages. Conventional cigarette paper wraps of flax or wood pulp such as those available from Ecusta Corp. and Kimberly-Clark Corp. are suitable. Exemplary wrapping materials can be the calcium carbonate and flax papers such as the commercially available Reference 719 paper from Ecusta Corp. Other wrapping materials can include papers having net permeabilities in the 50 to 250 CORESTA units range and inherent permeabilities in the 5 to 45 CORESTA range. Such papers are available as Ecusta TOD 03363 paper or Ecusta TOD 01788 paper from Ecusta Corp.

Volume expansion of the pieces or shreds of tobacco material within the rod is provided by placing the rods within an expansion chamber such as a high pressure container. The tobacco material within the rod is impregnated with a suitable fluid under supercritical conditions, and the fluid is vented in order to provide an expansion of the tobacco material. Typically, the expansion is provided by a gaseous fluid at relatively high temperature and pressure. The amount of expansion of the tobacco material can be controlled by varying the temperature or pressure of the fluid within the expansion chamber. Typically, process temperatures are maintained at less than about 250°C., preferably less than 200°C. in order to minimize or prevent damage to the tobacco material and/or wrapping material. Typical fluids, temperatures, pressures and other expansion conditions are set forth in U.S. Pat. No. 4,531,529, which is incorporated herein by reference. Examples of suitable expansion fluids include the light hydrocarbons, the halogenated hydrocarbons, and the like. The amount of expansion of the tobacco material can be controlled by diluting the expansion fluid with a diluent such as nitrogen, carbon dioxide, or the like. If desired, certain flavors can be incorporated into the fluid and deposited onto the cut filler during the impregnation step of the expansion process.

The process of this invention provides several advantages for the artisan skilled in the manufacture of cigarettes. For example, cigarette rods can be manufactured having reduced filler weights (eg., up to about 40 percent less filler weight and more typically up to about 30 percent less filler weight), and subjected to expansion conditions to exhibit rods of good firmness and integrity. For example, a cigarette rod provided according to the process of this invention can have a reduction in packing density of up to about 40 percent with respect to a cigarette of comparable format (i.e., identical initial blend materials, wrapping materials, filter materials, and dimensions of components) which has not been subjected to the expansion process of this invention. However, such a cigarette rod of reduced packing density exhibits a comparable firmness (i.e., within about 2 firmness units) to the cigarette of comparable format which has not been subjected to the expansion process of this invention. Generally, rods of increased circumference can exhibit greater relative weight reductions, as loosely packed rods of relatively great circumference are easier to manufacture and handle prior to the expansion processing steps.

The process of this invention can provide a convenient method for denicotinizing tobacco (eg., remove the nicotine content of the tobacco blend by up to about 30 weight percent or more). However, the removal of nicotine is provided along with a relatively low loss of tobacco sugars.

The process of this invention can be employed to manufactured cigarettes without affecting to any significant degree the porosity of the wrapping material, or the size or filtration properties of the filter tow.

The following examples are provided in order to further illustrate the invention but should not be construed as limiting the scope thereof. Unless otherwise noted, all parts and percentages are by weight.

EXAMPLE 1

Into a pressure vessel having a volume of 4.5 liters and capable of containing pressures above 100 Kg/cm$^2$ is placed several cigarettes. Each cigarette has a circumference of about 24.5 mm, and a length of about 84 mm, wherein each tobacco rod length is about 57 mm and each cellulose acetate filter element is about 27 mm in length. The cigarettes have conventional paper wrapping materials, and are manufactured using conventional cigarette manufacturing techniques. The filler material is shreds or strands of tobacco material cut at about 32 cuts per inch, and which has been cased and top dressed. The tobacco material is essentially a conventional American blend (see C. L. Browne, *The Design of Cigarettes,* p. 27 (1979)).

Once the cigarettes are placed within the chamber, the chamber is sealed and propane is pumped into the chamber until a pressure of 1,600 psig is reached. When the pressure reaches 1,600 psig, the temperature within the chamber is 255°F. The cigarettes are held within the chamber for a total of 5 minutes (including pressure pump up time). The propane is then vented, and the chamber reaches atmospheric pressure in about 20 seconds.

The cigarettes removed from the chamber are very firm in character. The cut filler undergoes volume expansion while within the tubular outer wrap. The paper wrap does not split or discolor, and the cellulose acetate filter does not undergo any visible change (eg., discoloration).

EXAMPLE 2

A closed, commercially available, fully colored, soft-pack package of 20 cigarettes is placed into the chamber described in Example 1. The cigarettes are described in Example 1. The clear, colorless, polypropylene overwrap of the package is removed prior to placing the package in the chamber. The package is subjected to the conditions described in Example 1.

The package does not undergo any noticeable change; and the tobacco material within the tobacco rod of each cigarette is volume expanded, as described in Example 1.

Packages of commercially available cigarettes in various crush proof box configurations are processed under similar conditions, and similar results are obtained.

EXAMPLE 3

Flue-cured tobacco lamina is cut at 58 cuts per inch and adjusted to a 13.7 percent moisture content. The resulting cut filler is employed to make tobacco rods of 100 mm length, 24.38 mm circumference, 2.1125 g weight, 3.59 firmness units, a water pressure drop of 297 mm at an airflow rate of 17.5 cc/sec, and a rod moisture content of 13.55 percent. The rod is manufactured using a Molins 6-8-6 Cigarette Maker from Molins, Great Britain, and the circumscribing wrap is a paper wrap commercially available as Reference 856 Paper from Kimberly-Clark Corp.

Into a wire basket (6 inches diameter and 4 inches deep) is placed 20 of the previously described rods. Into an electrically heated pressure cooker is charged one pint liquid of Freon F-11. The basket containing the 20 rods is placed into the pressure cooker in order that the tobacco rods are not immersed in the liquid halocarbon. The pressure cooker then is sealed with an airtight lid equipped with a pressure gauge. The pressure cooker is heated until an internal pressure of 30 psi is achieved. The 30 psi pressure is maintained for 20 minutes. The temperature within the pressure cooker is believed to be in the 120°F. to 150°F. range. Then, the pressure cooker is vented, and the rods are immediately placed in a kitchen-type microwave oven set at full power for 1 minute. Then the rods are allowed to cool for 30 minutes.

The resulting rods essentially maintain their original size and weight. The rods are very firm and the tobacco filler is volume expanded. The firmness of the rods is about 0.1 unit, and the pressure drop exceeds 1100 mm water pressure drop at an airflow rate of 17.5 cc/sec.

The rods can be cut into short, cylindrical segments of about 10 mm and employed as filter elements to be positioned at the extreme mouthend of cigarettes.

EXAMPLE 4

Cigarettes having lengths of about 84 mm and circumferences of about 24.86 mm have tobacco rod lengths of 57 mm and filter element lengths of 27 mm. The tobacco rod includes a charge of tobacco cut filler contained in a circumscribing cigarette paper wrap. The filler material employed in providing the tobacco rod is in the form of shreds or strands cut at about 32 cuts per inch. The initial filler material is essentially a conventional American blend of which 63 percent of the blend has been volume expanded to about twice its original volume. The blend has a water and glycerin casing applied thereto.

The paper wrap is sold commercially as Ecusta Reference TOD 03363 by Ecusta Corp. The paper wrap is a heavy weight sheet, low visible sidestream paper, and contains about 25 percent magnesium hydroxide and 15 percent calcium carbonate. The paper has an inherent permeability of 15 CORESTA units and a basis weight of 45 g/m$^2$. The paper is electrostatically perforated in order to yield a net permeability of 110 CORESTA units. The individual perforations each have a size comparable to conventional electrostatic perforations in conventional cigarette wrap, and are positioned with about 1 to about 10 perforations/mm essentially linearly in the longitudinal direction such that the lines of perforations are positioned about 1 mm to about 3 mm apart.

The moderate efficiency filter element is manufactured using conventional cigarette filter making technology from cellulose acetate tow (2.7 denier per filament, 46,000 total denier) and circumscribing air permeable paper plug wrap having a porosity of 7,000 cm/min.

The tobacco rod and filter element have similar circumferences, are aligned in an abutting, end-to-end relationship, and are secured together using tipping paper having a porosity of 2,500 ml/min. The tipping paper is adhesively secured to the filter element and the adjacent portion of the tobacco rod. The tipping material circumscribes the length of the filter element and about 4 mm of the length of the tobacco rod. Cigarettes so described are manufactured using a Hauni Protos Cigarette Maker from Hauni-Werke Korber & Co. KG. A ring of mechanically provided perforations thus providing the permeability extends around the periphery of the cigarette about 13 mm from the extreme mouthend thereof. The perforations so provided yield cigarettes with about 31.5 percent air dilution.

The cigarette weighs 0.8283 g and the tobacco rod weighs 0.5193 g. The tobacco rod exhibits a firmness of 10.71 units, and the cigarette exhibits a pressure drop of 126 mm water at an airflow rate of 17.5 cc/sec. The nicotine content of the tobacco blend is 1.98 percent. The cigarette is smoked under FTC conditions. The cigarette yields 6.0 mg FTC "tar", 0.48 mg nicotine, 11.1 mg carbon monoxide, 7.3 mg wet total particulate matter (WTPM) and a puff count of 6.3. The cigarette exhibits a static burn rate of 52.1 mg/min or 4.9 mm/min.

The previously described cigarette is subjected to conditions as described in Example 1 such that the filler is volume expanded. The resulting cigarette has identical weight and dimensions after being subjected to the expansion conditions, and the TOD 03363 paper undergoes a very slight yellowing. The tobacco rod exhibits a firmness of 1.60 units, and the cigarette exhibits a pressure drop of 122.4 mm water at an airflow rate of 17.5 cc/sec. The nicotine content of the tobacco blend is 1.51 percent. The cigarette exhibits an air dilution of 63.8 percent. The cigarette is smoked under FTC conditions. The cigarette yields 3.7 mg FTC "tar," 0.26 mg FTC nicotine, 5.7 mg carbon monoxide, 4.4 mg WTPM, and a puff count of 7.5. The static burn rate of the cigarette is 47.8 mg/min or 4.6 mm/min.

This example illustrates that tobacco can be denicotinized while within a manufactured cigarette. The process steps of this invention do not significantly affect the static burn rate of the cigarette even through the firmness of the cigarette is changed by over 9 firmness units. Also, the air dilution of a cigarette can increase by expansion of the filler therein using the process of this invention. The FTC smoke results indicate that the cigarettes processed according to this invention can exhibit decreased CO/"tar" ratios and increased "tar"-/nicotine ratios.

EXAMPLE 5

A cigarette is provided using the procedure and materials described in Example 4, except that a lesser amount of cut filler is employed in manufacturing the tobacco rod and the cigarette is about 27.7 percent air diluted. The weight of the cigarette is 0.7775 g and the weight of the tobacco rod is 0.4685 g. The tobacco rod exhibits a firmness of 15.40 units, and the cigarette exhibits a pressure drop of 109.6 mm water at an airflow rate of 17.5 cc/sec.

The previously described cigarette is subjected to conditions described in Example 1 such that the filler is volume expanded. The resulting cigarette has identical weight and dimensions after being subjected to volume expansion conditions, and the filler is firmly packed within the circumscribing paper wrap. The tobacco rod exhibits a firmness of 9.54 units, and the cigarette exhibits a pressure drop of 97.3 mm water at an airflow rate of 17.5 cc/sec. The cigarette exhibits an air dilution of 48 percent, and a static burn rate of 45.8 mg/min or 5.4 mm/min..

The example illustrates that cigarettes of reduced weight, and acceptable firmness, static burn rate and pressure drop can be manufactured using the process of this invention.

EXAMPLE 6

Cigarettes having lengths of about 100 mm and circumferences of about 24.87 mm have tobacco rod lengths of 71.5 mm and filter element lengths of 27.5 mm. The tobacco rod includes a charge of tobacco cut filler contained in a circumscribing cigarette paper wrap. The paper wrap is commercially available as Reference 719 from Ecusta Corp. The filler material employed in providing the tobacco rod is in the form of shreds or strands cut at about 32 cuts per inch. The initial filler material includes a blend of about 15 percent flue-cured and burley tobaccos which previously have been volume expanded to about twice the original volume, about 25 percent burley tobacco, about 16 percent oriental tobaccos, about 18 percent flue-cured tobacco and about 26 percent processed tobacco sheet. The blend has a casing of flavorant, water and glycerin applied thereto. The blend also has menthol applied thereto such that the menthol content of the cigarette is 0.41 percent.

The filter element is manufactured using conventional cigarette filter making technology from cellulose acetate tow (4.2 denier per filament, 40,000 total denier) and circumscribing air permeable paper plug wrap having a porosity of 1,700 cm/min.

The tobacco rod and filter element have similar circumferences, are aligned in an abutting, end-to-end relationship, and are secured together using tipping paper (having a porosity of 550 ml/min). The tipping paper is adhesively secured to the filter element and the adjacent portion of the tobacco rod. The tipping material circumscribes the length of the filter element and about 4 mm of the length of the tobacco rod. Cigarettes so described are manufactured using a Hauni Protos Cigarette Maker from Hauni-Werke Korber & Co. KG. A ring of mechanically provided perforations thus providing the permeability extends around the periphery of the cigarette about 17 mm from the extreme mouthend thereof. The perforations so provided yield cigarettes with about 14.3 percent air dilution.

The cigarette weighs 1.1402 g and the tobacco rod weighs 0.9044 g. The tobacco rod exhibits a firmness of 7.32 units, and the cigarette exhibits a pressure drop of 118 mm water at an airflow rate of 17.5 cc/sec. The nicotine content of the tobacco blend is 1.62 percent. The cigarette is smoked under FTC conditions. The cigarette yields 15.4 mg FTC "tar", 1.04 mg nicotine, 16.7 mg carbon monoxide, 7.3 mg WTPM and a puff count of 8.6.

The previously described cigarette is subjected to conditions as described in Example 1 such that the filler is volume expanded. The resulting cigarette has identical weight and dimensions after being subjected to the expansion conditions. The tobacco rod exhibits a firmness of 1.36 units, and the cigarette exhibits a pressure drop of 223.5 mm water at an airflow rate of 17.5 cc/sec. The nicotine content of the blend is 1.59 percent, and the menthol content of the blend is 0.21 percent. The cigarette exhibits an air dilution of 43.8 percent. The cigarette is smoked under FTC conditions. The cigarette yields 7.2 mg "tar", 0.41 mg nicotine, 7.7 mg carbon monoxide, 8.4 mg WTPM and a puff count of 10.

The example illustrates that tobacco can be volume expanded while within a paper wrap and the menthol which has been applied to blend is not totally removed during the expansion process.

Only a small amount of denicotinization takes place during processing steps of this cigarette. Major changes in the FTC smoke results result from the increased effective air dilution which occurs upon processing the cigarette according to the process of this invention. The processed cigarette yields an increased puff count (i.e., about 1.5 puffs) over the unprocessed cigarette.

EXAMPLE 7

A cigarette is provided using the procedure and materials described in Example 6, except that a lesser amount of cut filler is employed in manufacturing the tobacco rod and the cigarette is about 9 percent air diluted. The weight of the cigarette is about 0.9771 g and the weight of the tobacco rod is 0.7413 g. The nicotine content of the blend is 1.62 percent. The tobacco rod exhibits a firmness of 15.42 units and the cigarette exhibits a pressure drop of 89.4 mm water at an air flow rate of 17.5 cc/sec.

The previously described cigarette is subjected to conditions described in Example 1, such that the filler is volume expanded. The resulting cigarette has identical weight and dimensions after being subjected to volume expansion conditions, and the filler is firmly packed within the circumscribing paper wrap. The tobacco rod exhibits a firmness of 6.38 units, and the cigarette exhibits a pressure drop of 133.6 mm water at an airflow rate of 17.5 cc/sec. The cigarette exhibits an air dilution of 25.7 percent. The nicotine content of the blend is 1.28 percent.

The example indicates that cigarettes of reduced weight can be provided according to the process of this invention. However, the low weight cigarettes have acceptable firmness and pressure drop.

What is claimed is:

1. A process for providing a rod suitable for the use in the manufacture of smoking articles, the process comprising:

(i) providing a tobacco rod having a tobacco filler material contained in a circumscribing wrapping (ii) impregnating the tobacco filler material with a halocarbon or hydrocarbon fluid; and then (iii) subjecting the tobacco rod to conditions sufficient to provide volume expansion to at least a portion of the tobacco material.

2. A process for providing a rod suitable for use in the manufacture of smoking articles, the process comprising:

(i) providing a tobacco rod having a tobacco filler material contained in a circumscribing wrapping material; and then (ii) subjecting the tobacco rod to conditions sufficient to provide volume expansion to at least a portion of the tobacco material by impregnating the tobacco material with a fluid under supercritical conditions, and then releasing the fluid from supercritical conditions.

3. The process of claim 1 or 2 whereby the wrapping material of the resulting rod is not visibly altered thereby.

4. The process of claim 1 or 2 whereby the tobacco material which is subjected to the volume expansion includes tobacco cut filler and previously volume expanded tobacco filler material.

5. The process of claim 1 or 2 whereby the tobacco material includes tobacco laminae cut filler and reconstituted tobacco cut filler.

6. The process of claim 1 or 2 whereby the volume expansion conditions include a temperature less than 200°C.

7. The process of claim 1 or 2 whereby the volume expansion conditions include a temperature less than 150°C.

8. The process of claim 1 or 2 whereby the rod comprises menthol, and whereby the volume expansion conditions so provided are such that not all menthol present within the smoking article is removed thereby.

9. The process of claim 1 or 2 whereby the rod comprises menthol, and whereby the volume expansion conditions so provided are such that less than about 60 percent of the menthol present within the smoking article is removed thereby.

10. The process of claim 1 or 2 whereby the tobacco material includes tobacco stems.

11. The process of claim 1 or 2 whereby the volume expansion conditions are such that the resulting tobacco rod exhibits a reduction of packing density of up to 40 percent and comparable firmness with respect to a rod of comparable format which is not subjected to the process.

12. The process of claim 2 whereby the fluid comprises propane.

13. The process of claim 1 whereby the tobacco material is contacted with a gaseous expansion agent at a pressure above about 4.5 $Kg/cm^2$ below the critical pressure of the expansion agent, and at a temperature in the range of from about 20°C. below to about 42°C. above the critical temperature of the expansion agent; and subsequently releasing the pressure within a time period of from 1 second to 10 minutes, thereby causing the tobacco material to expand.

14. The process of claim 13 whereby the expansion agent comprises propane.

15. The process of claim 1, 2 or 12 whereby the rod includes a paper wrap such that a burnable cigarette rod is provided.

16. A process for providing a cigarette-type smoking article, the process comprising:

(a) providing a smokable rod having tobacco filler material contained in a generally tubular shaped circumscribing wrapping material; and then (b) subjecting the rod to conditions sufficient to provide volume expansion to at least a portion of the tobacco material; and then (c) positioning a rod-shaped member having a means for providing the passage of air and smoke therethrough adjacent one end of the smokable rod in an end-to-end relationship; and (d) positioning a rod-shaped filter element adjacent the opposite end of the rod-shaped member in an end-to-end relationship.

17. The process of claim 16 whereby the rod-shaped member is a tubular member.

18. The process of claim 16 or 17 whereby the smokable rod, rod-shaped member and filter element are secured in alignment by circumscribing the filter element, the rod shaped member and a portion of the length of the smokable rod adjacent the rod shaped member with a tipping material.

19. The process of claim 16 or 17 whereby the volume expansion is provided by impregnating the tobacco material with a fluid under supercritical conditions, and then releasing the fluid from supercritical conditions.

20. The process of claim 19 whereby the fluid comprises propane.

21. A process for providing a rod for the manufacture of filter elements for smoking articles, the process comprising:

(a) providing a rod having tobacco filler material contained in a generally tubular shaped circumscribing wrapping material; and then (b) subjecting the rod to conditions sufficient to provide volume expansion to at least a portion of the tobacco material.

22. The process of claim 21 whereby the rod is subjected to volume expansion conditions such that the rod exhibits a firmness value of less than 2 units as measured at 76°F. and 60 percent relative humidity using a Cigarette Firmness Tester Model No. CFTA supplied by Fairchild Industries.

23. The process of claim 21 whereby the volume expansion is provided by impregnating the tobacco material with a fluid under supercritical conditions, and then releasing the fluid from supercritical conditions.

24. The process of claim 16 whereby the tobacco filler material is impregnated with a halocarbon or hydrocarbon fluid prior to the time that the rod is subjected to conditions to provide volume expansion to at least a portion of the tobacco material.

25. The process of claim 21 whereby the tobacco filler material is impregnated with a halocarbon or hydrocarbon fluid prior to the time that the rod is subjected to conditions to provide volume expansion to at least a portion of the tobacco material.

26. The process of claim 21 whereby the fluid comprises propane.

27. The process of claim 2 whereby the volume expansion is provided using a halocarbon or hydrocarbon fluid.

28. The process of claim 1, 2, 24, 25 or 27 whereby the fluid includes a diluent.

29. A process for removing a portion of the nicotine from tobacco filler material, the process comprising:

(i) providing a tobacco rod having a tobacco filler material contained in a circumscribing wrapping material; and then (ii) impregnating the tobacco material with a fluid under supercritical conditions and releasing the fluid from supercritical conditions.

* * * * *